US005443004A

United States Patent [19]

Kohara et al.

[11] Patent Number: 5,443,004

[45] Date of Patent: Aug. 22, 1995

[54] INK FOUNTAIN APPARATUS

[75] Inventors: Yuji Kohara, Kodaira; Tadashi Hachiya, Yokohama, both of Japan

[73] Assignee: Tokyo Kikai Seisakusho, Ltd., Tokyo, Japan

[21] Appl. No.: 301,404

[22] Filed: Sep. 8, 1994

[30] Foreign Application Priority Data

Nov. 13, 1993 [JP] Japan ..... 5-307571

[51] Int. Cl.[6] ..... B41F 31/04; B41F 31/06

[52] U.S. Cl. ..... 101/365

[58] Field of Search ..... 101/365, 350, 363, 157, 101/169, 366, 364; 118/261

[56] References Cited

U.S. PATENT DOCUMENTS 3,730,090 5/1973 Camber et al. ..... 101/365

FOREIGN PATENT DOCUMENTS 2-84339 3/1990 Japan .

4-25329 6/1992 Japan .

*Primary Examiner*—J. Reed Fisher

*Attorney, Agent, or Firm*—Armstrong, Westerman, Hattori, McLeland & Naughton

[57] ABSTRACT

An ink fountain apparatus comprises a storage part for forming an ink storage space in cooperation with an external periphery of a fountain roller, the storage part including a bottom portion having a front edge which is opposed to the external periphery of the fountain roller with a gap defined by the front edge and the external periphery, the gap serving as an inc supplying port, an ink supply adjusting member arranged movably forward and rearward in contact/separation directions with respect to the fountain roller to adjust the degree of opening of the ink supplying port by means of the front edge of the ink supply adjusting member, a screw feeding mechanism for driving the ink supply adjusting member to move it forward and rearward, and stopper means for restricting the rotation of a rotation driving member of the screw feeding mechanism.

The stopper means includes stopper parts which are respectively provided on the rotation driving member and a fixed part attached to the storage part, and which have side portions engageable with each other in a direction of rotation.

3 Claims, 4 Drawing Sheets

INK FOUNTAIN APPARATUS

BACKGROUND OF THE INVENTION

1. Field of the Invention

This invention relates to an ink fountain apparatus for a printing press and, more particularly, to an ink fountain apparatus provided with a mechanism for adjusting the degree of opening of an ink supplying port by rotating an engaged screw to effect positional adjustment of an ink blade displaceable toward and away from a fountain roller.

2. Description of the Prior Art

For example, Japanese Utility Model Laid-Open No. 25329/1992 and Japanese Patent Laid-Open No. 84339/1990 disclose different prior arts of an ink fountain apparatus provided with a mechanism for adjusting the degree of opening of an ink supplying port, by rotating an engaged screw to effect positional adjustment of an ink blade displaceable toward and away from a fountain roller.

In the prior art disclosed in Japanese Utility Model Laid-Open No. 25329/1992, a gear for transmitting drive to the ink blade is engaged with a screw fixed at both ends thereof, and a stopper projection is provided so as to give the gear a reaction force acting in a direction opposite to the rotating direction of the gear. A stopper projection provided on one side of the gear is adapted to come into abutment with the aforesaid stopper projection, and the position in which the ink blade is stopped by the abutment defines the maximum or minimum limit of the degree of opening of the ink supplying port.

In the prior art disclosed in Japanese Patent Laid-Open No. 84339/1990, a potentiometer provided which interlocks with the gear for transmitting drive to the ink blade. When the potentiometer reaches a predetermined value, a driving motor is stopped so that the ink blade is stopped. The position of the ink blade at that time defines the maximum or minimum limit of the degree of opening of the ink supplying port.

The above-described prior art ink fountain apparatuses have the following disadvantages, respectively.

In the prior art disclosed in Japanese Utility Model Laid-Open No. 25329/1992, the abutment between the stopper projection for defining the maximum and minimum limits of the degree of opening of the ink supplying port and the stopper projection provided on one side of the driving transmitting gear is realized by utilizing the amounts of displacement of the side faces of the stopper projections due to one rotation of the gear, i.e., by using at most a thread portion of only one pitch of only the engaged screw.

As a result, because of the backlash of the thread of the screw, the position in which the ink blade is stopped by the stopper projections may be varied in the range of one rotation of the gear, i.e., the size of one pitch, or the ink blade may stop with the front end faces of the stopper projections butting against each other, so that accuracy will be impaired by the drawbacks. If the ink blade stops with the front end faces of the stopper projections butting against each other, the externally threaded portion of the gear and the screw may bite into each other ink the movement between them becomes stiff.

Further, adjustment of the attachment position of each of the stopper projections for the purpose of avoiding the above-described problems requires subtle and difficult processes, and the operation of assembling the stopper projections needs skill. This increases the burden of the workers.

In the prior art disclosed in Japanese Patent Laid-Open No. 84339/1990, since it is necessary to employ a potentiometer for detecting the maximum and minimum limits of the degree of opening of the ink supplying port, and an electrical circuit associated therewith, the cost increases and the accuracy is lowered by noise or the like.

SUMMARY OF THE INVENTION

This invention relates to an ink fountain apparatus in which the problems of the described-above prior arts are simultaneously solved.

The ink fountain apparatus according to the invention comprises a storage part for forming an ink storage space in cooperation with an external periphery of a fountain roller, the storage part including a bottom portion having a front edge which is opposed to the external periphery of the fountain roller with a gap defined by the front edge and the external periphery, the gap serving as an ink supplying port, an ink supply adjusting member arranged movably forward and rearward in contact/separation directions with respect to the fountain roller to adjust the degree of opening of the ink supplying port by means of the front edge of the ink supply adjusting member, a screw feeding mechanism for driving the ink supply adjusting member to to move it forward and rearward, and stopper means for restricting the range of rotation of a rotation driving member of the screw feeding mechanism with respect to the fixed side.

The stopper means are stopper parts which are respectively provided on the members on the fixed side and the rotation driving side, and have side portions engageable with each other in the direction of rotation.

To enlarge the range of rotation of the rotation driving member of the screw feeding mechanism with respect to the fixed part, in addition to the stopper parts provided on the fixed part and the rotation driving member of the screw feeding mechanism, stopper parts are provided on an appropriate number of intermediate free-rotating members rotatably disposed in coaxial relationship with respect to the rotational driving member.

If the number of intermediate free-rotating members is one, stopper parts the side portions of which are engageable with each other in the direction of rotation are respectively provided on the fixed part, the rotational driving member of the screw feeding mechanism and the intermediate free-rotating member. The intermediate free-rotating member has two stopper parts, and one of the two stopper parts is engageable with the stopper part of the rotation driving members, while the other of the two stopper parts is engageable with the stopper part of the fixed part.

If a plurality of intermediate free-rotating members are provided, stopper parts the side portions of which are engageable with each other in the direction of rotation are provided on the fixed part, the rotation driving member of the screw feeding mechanism and the plurality of intermediate free-rotating members. Each of the intermediate free-rotating members is provided with two stopper parts. The stopper part of the rotation driving member is engageable with one of the two stopper parts of one of the intermediate free-rotating members, while the stopper part of the fixed part is engageable with one of the two stopper parts of another of the intermediate free-rotating members. The other stopper parts of these respective intermediate free-rotating members are directly engageable or indirectly engageable via the stopper parts of the rest intermediate free-rotating members which are sequentially engageable.

In the above ink fountain apparatus, ink stored in the storage part adheres to the external periphery of the fountain roller that is exposed in the ink storage space. As the fountain roller rotates, ink is sequentially applied in the form of a film to the external periphery of the fountain roller by an amount determined by the ink supplying port the degree of opening of which is restricted by the front edge of the ink supply adjusting member, i.e., by an amount determined by the gap between the front edge of the ink supply adjusting member and the external periphery of the fountain roller.

To adjust the amount of ink to be supplied, i.e., the degree of opening of the ink supplying port which is the gap between the front edge of the bottom portion and the external periphery of the fountain roller, the rotational driving member of the screw feeding mechanism performs a forward or rearward rotation. Thus, the ink supply adjusting member slides toward or away from the fountain roller by the screw feeding mechanism. Accordingly, the degree of opening of the ink supplying port is adjusted by the front edge of the ink supply adjusting member.

For example, if the rotational driving member performs a forward rotational driving, the ink supply adjusting member moves forward to reduce the degree of opening of the ink supplying port. If the rotational driving member performs a rearward rotational driving, the ink supply adjusting member moves rearward to increase the degree of opening of the ink supplying port.

The displacement of the ink supply adjusting member during the adjustment of the degree of opening of the ink supplying port is restricted in the following manner.

If the stopper part of the rotation driving member directly abuts against the stopper part of the fixed part, or if one of the stopper parts of the intermediate free-rotating member abuts against one side portion of the stopper part of the fixed part and the stopper part of the rotation driving member abuts against the other side portion of the other stopper part of the intermediate free-rotating member, or if stopper part of one intermediate free-rotating member abuts against one side portion of the stopper part of the fixed part and the otter stopper part directly abuts against the stopper part of the rotation driving member or indirectly via the stopper parts of the rest intermediate free-rotating members which are arranged in sequence, the front edge of the ink supply adjusting member takes its lower-limit position at which the degree of opening of the ink supplying port is a minimum. For example, the front edge abuts against the external periphery of the fountain roller, and the degree of opening of the ink supplying port is reduced to zero.

Then, if the rotation driving member is rotated in one direction, the ink supply adjusting member moves rearward by means of the screw feeding mechanism so that the front edge moves away from the external periphery of the fountain roller and the degree of opening of the ink supplying port progressively increases. Simultaneously, the stopper part of the rotation driving member turns in the same direction.

Then, after approximately one rotation, the stopper part of the rotation driving member comes into abutment with the stopper part of the fixed part, so that the rotation of the stopper part of the rotation driving member is stopped. Thus, the rotation of the rotational driving member the stopper part of which abuts against the stopper part of the fixed part comes to a stop after approximately one rotation. Otherwise, the stopper part of the rotation driving member comes into abutment with the other side portion of the stopper part of the intermediate free-rotating member, and presses it to continue to turn together with the intermediate free-rotating member, thereby rotating the intermediate free-rotating member. After one more rotation, the other stopper part of the intermediate free-rotating member which turns in the same direction is mate to abut against the stopper part of the fixed part. Thus, since the rotation of the intermediate free-rotating member is stopped, the rotation of the rotation driving member the stopper part of which abuts against the stopper part of the intermediate free-rotating member comes to a stop after approximately two rotations.

Otherwise, the stopper part of the rotation driving member comes into abutment with one side portion of either stopper part of one intermediate free-rotating member, and presses it to turn together with the intermediate free-rotating member, thereby rotating the intermediate free-rotating member. After one more rotation, the other stopper part of the intermediate free-rotating member is made to abut against one stopper part of the next one of the remaining intermediate free-rotating members, and the rotation driving member continues to rotate the next intermediate free-rotating member. Thus, the rotation driving member continues to sequentially rotate the rest intermediate free-rotating members, and when the stopper part of the last intermediate free-rotating member comes into abutment with the stopper part of the fixed part, the rotation of the rotation driving member comes to a stop.

Accordingly, if a plurality of intermediate free-rotating members are provided, the extent of rotation of the rotation driving member is expressed by (the number of rotations approximately equal to the number of intermediate free-rotating members)+(one rotation).

In each of the above-described cases, owing to the screw feeding mechanism, the front edge of the ink supply adjusting member takes its upper-limit position at which the degree of opening of the ink supplying port is a maximum. Accordingly, the degree of opening of the ink supplying port 7 is the maximum.

The above and other objects, features and advantages of the present invention will become apparent from reading of the following description which has been made in connection with the accompanying drawings.

BRIEF DESCRIPTION OF THE DRAWINGS

The present invention is illustrated in the following drawings in which.

DESCRIPTION OF THE PREFERRED EMBODIMENTS

Embodiments of an ink fountain apparatus according to the present invention will be described below with reference to the accompanying drawings.

Figure 1:
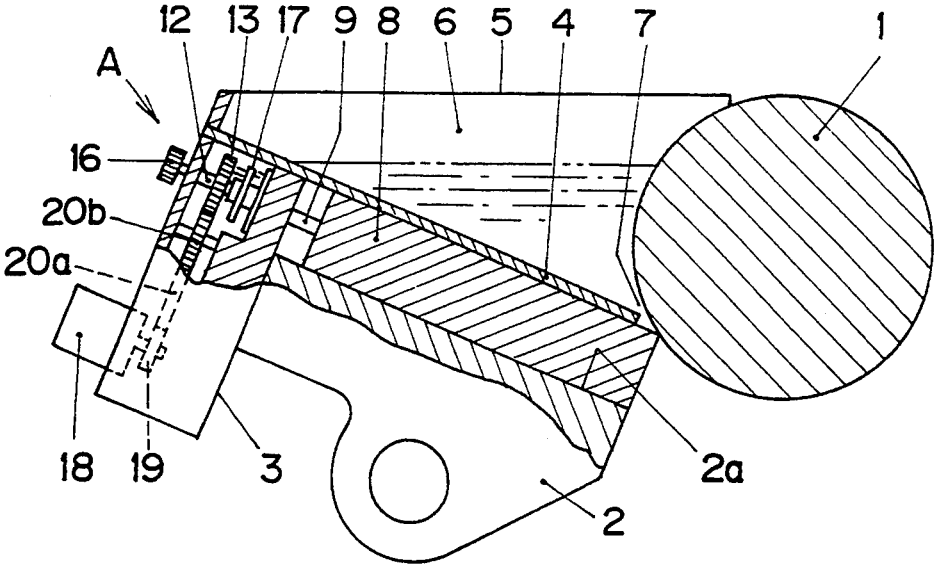
FIG. 1 is a partly cross-sectional view showing a first embodiment of an ink fountain apparatus according to this invention.

As shown in FIG. 1, in the first embodiment of the ink fountain apparatus, a base 2 having an inclined face 2*a* inclined down toward the fountain roller 1 is so provided as to oppose the fountain roller 1. A adjusting-part housing 3 is provided at the rear end of the base 2, and a bottom plate 4 is provided in parallel with the inclined face 2*a* in such a manner as to be spaced therefrom by an appropriate distance. The lower end of the bottom plate 4 is opposed to the external periphery of the fountain roller 1 with a small gap formed between the lower end and the external periphery. Side plates 5 are respectively provided to extend upward from both side edges of the bottom plate 4, and each of the side plates 5 has an arcuate, front edge which makes contact with the external periphery of the fountain roller 1.

A groove-like space 6 is formed by the bottom plate 4, the side plates 5 and the external periphery of the fountain roller 1, and ink is stored in the groove-like space 6. The small gap between the lower end of the bottom plate 4 and the external periphery of the fountain roller 1 serves as an ink supplying port 7.

An ink blade 8 is inserted between the inclined face 2*a* of the base 2 and the bottom plate 4 in such a manner as to be slidable into and out of contact with the fountain roller 1. The ink blade 8 is positionally adjusted by an adjusting part A, which will be described later, so that the front edge of the upper face of the ink blade 8 projects from the lower end of the bottom plate 4 and is movable into and out of contact with the external periphery of the fountain roller 1. The degree of opening of the ink supplying port 7 which is the small gap between the lower end of the bottom plate 4 and the external periphery of the fountain roller 1 is adjusted by the front edge of the upper face of the ink blade 8. In other words, the amount of ink to be supplied is controlled by the small gap between the front edge of the upper face of the ink blade 8 and the external periphery of the fountain roller 1.

Figure 2:
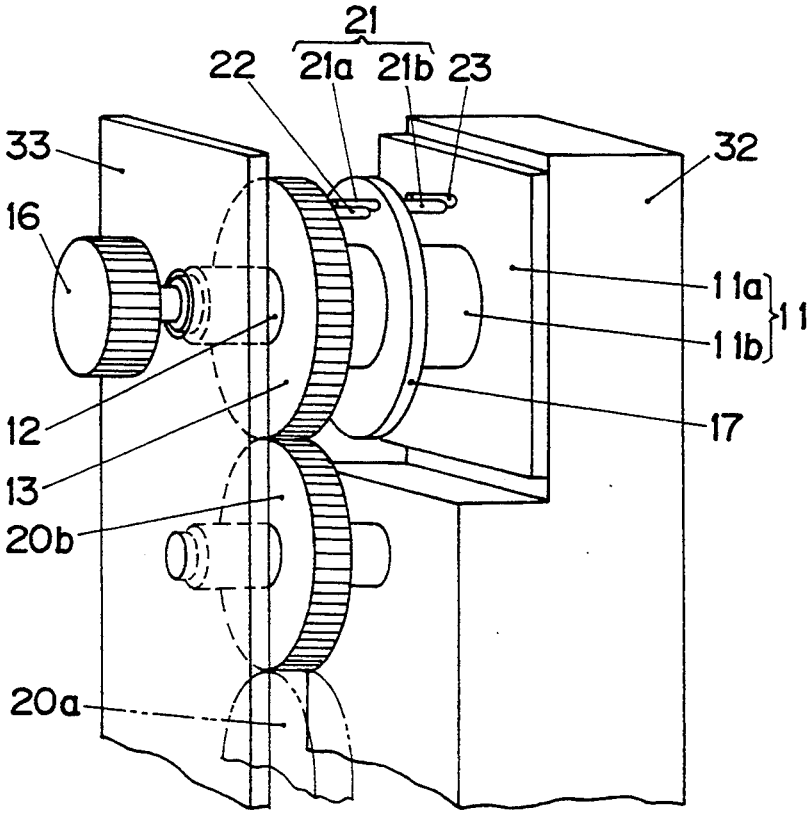
FIG. 2 is a perspective view showing a part for adjusting the degree of opening of the ink supply port of the first embodiment of the ink fountain apparatus according to the invention.
Figure 3:
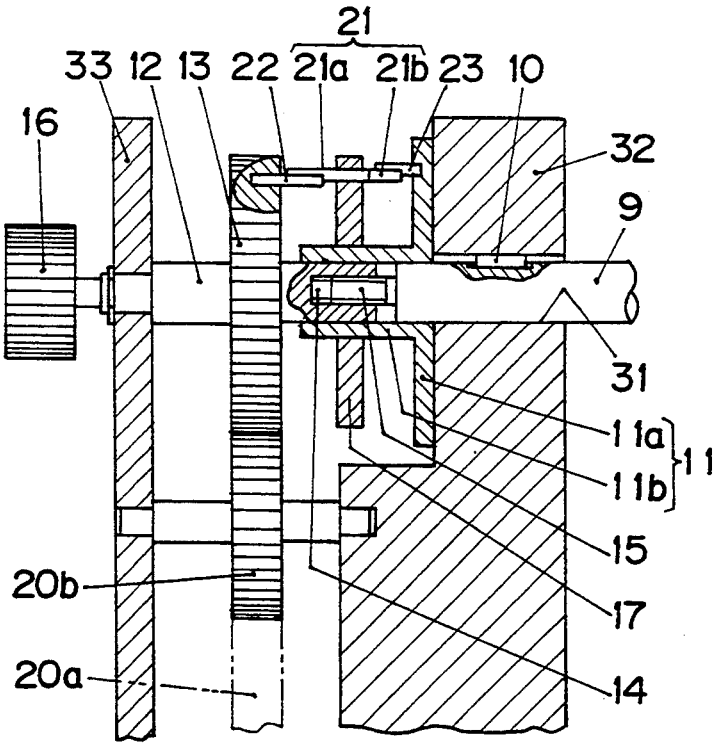
FIG. 3 is a cross-sectional view shoving the part for adjusting the degree of opening of the ink supply port of the first embodiment of the ink fountain apparatus according to the invention.

As shown in FIGS. 1, 2 and 3, the adjusting part A includes the adjusting-part housing 3 having a front wall portion 32 and a rear wall portion 33, and a slide hole 31 is formed through the front wall portion 32. A connecting rod 9 which extends rearward from the rear end of the ink blade 8 is fitted into the slide hole 31 in such a manner as to be axially slidable, and the rotation is restricted by a slide key 10.

A bracket 11 formed by a flange portion 11*a* and a tubular portion 11*b* is attached to the inside face of the front wall portion 32. Specifically, the flange portion 11*a* is attached to the inside face of the front wall portion 32, and the projecting end portion of the connecting rod 9 is slidably fitted into the tubular portion 11*b*.

In the adjusting-part housing 3, a gear shaft 12 is provided coaxially with the connecting rod 9, and the front end portion of the gear shaft 12 is fitted into the tubular portion 11*b* of the bracket 11, white the rear end portion of the gear shaft 12 is rotatably inserted through the rear wall portion 33. A gear 13 is attached to the gear shaft 12, and a threaded hole 14 is so formed as to axially extend in the front end portion of the gear shaft 12. A male threaded portion 15 which projects from the rear end of the connecting rod 9 is screwed into the threaded hole 14. A control knob 16 is attached to the projecting end of the gear shaft 12 which projects outward from the rear wall portion 33.

A flange-shaped, intermediate ring 17 is rotatably attached to the tubular portion 11*b* of the bracket 11 at a middle position between the gear 13 and the flange portion 11*a* of the bracket 11. A motor 18 which performs forward or rearward rotational drive under the control of a drive controlling device (not shown) is mounted on the rear wall portion 33, and a driving gear 19 is attached to a motor shaft which projects into the adjusting-part housing 3. A predetermined number of intermediate gears (in the embodiment shown in FIG. 1, two intermediate gears 20*a* and 20*b*) are interposed between the driving gear 19 and the gear 13 to constitute a gear train.

In the first embodiment of the ink fountain apparatus, as shown in FIGS. 2 and 3, projecting pins 21 are provided at predetermined, radial positions of the intermediate ring 17. The projecting pins 21 project from the intermediate ring 17 in opposite directions in parallel with the axis of the tubular portion 11*b*, and they are a first projecting portion 21*a* opposed to the gear 13 and a second projecting portion 21*b* opposed to the flange portion 11*a*. A rotation stopper pin 22 is planted to axially extend from the side of the gear 13 opposed to the intermediate ring 17, and a fixed stopper pin 23 is planted to axially extend from the flange portion 11*a* of the bracket 11. The radii of rotation of the projecting pin 21 and the rotation stopper pin 22 are equal to each other and equal to the distance between the fixed stopper pin 23 and the axis of the tubular portion 11*b*.

The amounts of projection of the first projecting portion 21*a*, the second projecting portion 21*b*, the rotation stopper pin 22 and the fixed stopper pin 23 are so selected that the first projecting portion 21*a*, the second projecting portion 21*b* and each of the rotating stopper pin 22 and the fixed stopper pin 23 are respectively spaced from the gear 13, the flange portion 11*a*, the intermediate ring 17 with a small gap formed therebetween and that the first projecting portion 21*a* and the second projecting portion 21*b* can respectively fully engage with the rotating stopper pin 22 and the fixed stopper pin 23 on their loci of rotation.

Modifications of the above-described first embodiment are shown in FIGS. 6(*a*) and 6(*b*).

In the modification shown in FIG. 6(*a*), a fixed stopper pin 23 is planted axially on a rear wall portion 33 of an adjusting-part housing 3. In the example shown in FIG. 6(*b*), a fixed stopper pin 23 is planted axially on a fixed ring 26 attached to an extending end of a tubular portion 11*b* of a bracket 11. Although a projecting pin 21 of an intermediate ring 17 is formed of a first projecting portion 21*a* and a second projecting portion 21*b*, 21*a*, 21*b* of two parallel parts which project in the same direction.

Figure 5:
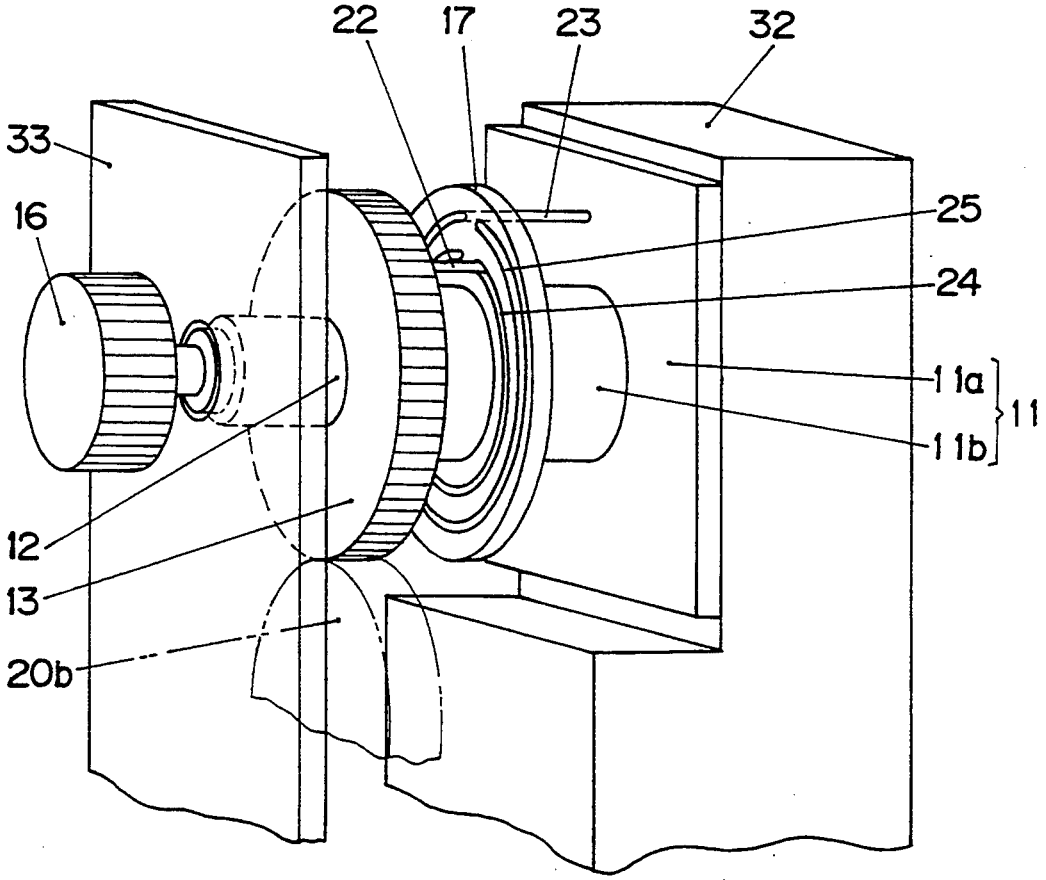
FIG. 5 is a perspective view showing a part for adjusting the degree of opening of the ink supply port of a second embodiment of the ink fountain apparatus according to the invention.
Figure 6A:
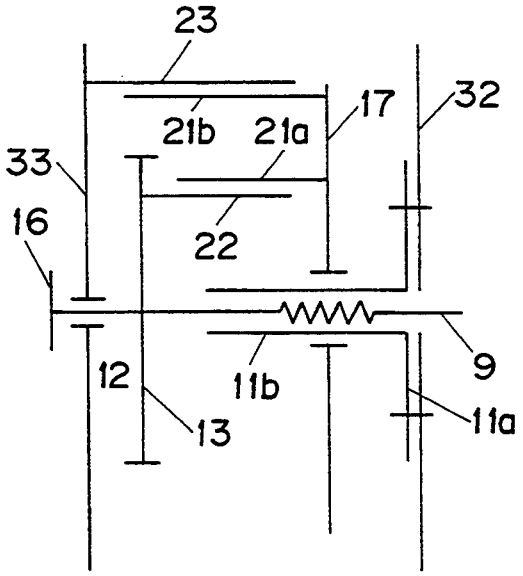
FIG. 6 (*a*)–(*d*) is a view showing the structure of a modification of the part for adjusting the degree of opening of the ink supply port of the first embodiment of the ink fountain apparatus according to the invention.
Figure 6C:
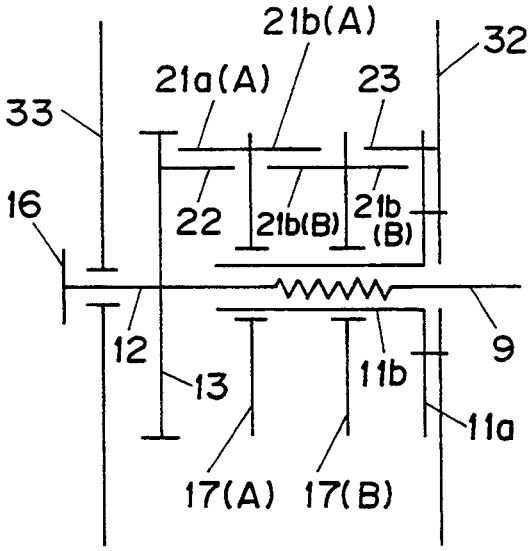
Figure 6B:
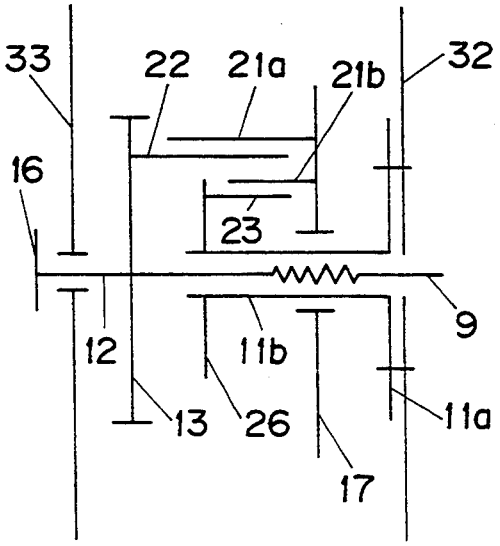
Figure 6D:
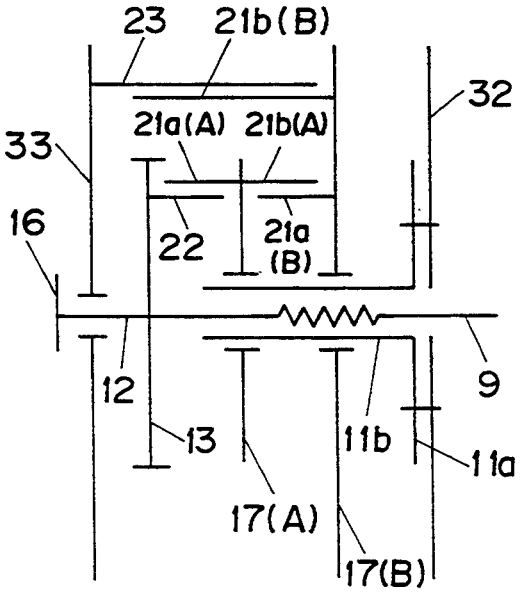

Although, in the first embodiment of the ink fountain apparatus, the projecting pin 21 made up of the first projecting portion 21*a* and the second projecting portion 21*b* is planted on the intermediate ring 17, the second embodiment of the ink fountain apparatus includes, instead of the projecting pin 21, a first arcuate slot 24 and a second arcuate slot 25 formed in the intermediate ring 17 as shown in FIG. 5.

The first arcuate slot 24 and the second arcuate slot 25 are formed through the intermediate ring 17 as concentric arcs each having a different radius (in the shown example, the first arcuate slot 24 has a small radius and the second arcuate slot 25 has a large radius). The first arcuate slot 24 and the second arcuate slot 25 are arcuate slots which have a large central angles and have ends spaced from each other by a distance approximately equal to the diameter of the projecting pin 21, i.e., have disconnection portion of a size approximately equal to the diameter of the projecting pin 21 and are in phase with each other.

The rotating stopper pin 22, which is planted axially on the side of the gear 13 opposed to the intermediate ring 17, has a radial position and a sufficient amount of projection both of which allow the rotating stopper pin 22 to engage with the first arcuate slot 24. Similarly, the fixed stopper pin 23, which is planted axially on the flange portion 11*a* of the bracket 11, has a radial position and a sufficient amount of projection both of which allow the fixed stopper pin 23 to engage with the second arcuate slot 25. The first arcuate slot 24 and the second arcuate slot 25 do not necessarily need to be formed to pierce the intermediate ring 17, and may also be opened on only the sides of the intermediate ring 17 which are respectively engaged with the rotating stopper pin 22 and the fixed stopper pin 23.

Although each of the first and second embodiments employs a single ring as the intermediate ring 17, a plurality of intermediate rings may be rotatably disposed side by side in such a manner that projecting pins similar to the aforesaid ones engage with each other between adjacent ones of the intermediate rings. Thus, it is possible to enlarge the range of rotation of the gear shaft 12, i.e., the range of adjusting movement of the ink blade 8. FIGS. 6(*c*) and 6(*d*) show different modifications each having a plurality of intermediate rings 17(A) and 17(B) (in each of the shown modifications, two intermediate rings), and the modifications of FIGS. 6(*c*) and 6(*d*) respectively correspond to the first embodiment shown in FIG. 3 and the modification of the first embodiment shown in FIG. 6(*a*).

The intermediate rings 17(A) 17(B) are provided with a first projecting portion 21*a*(A), 21*a*(B) and a second projecting portion 21*b*(A), 21*b*(B) respectively. In FIG. 6(*c*), as can be seen from the embodiment shown in FIG. 3, the fixed stopper pin 23 and the second projecting portion 21*b*(B) of the intermediate ring 17(B) can engage with each other, the first projecting portion 21*a*(B) of the intermediate ring 17(B) and the second projecting portion 21*b*(A) of the intermediate ring 17(A) can engage with each other, and the second projecting portion 21*a*(A) of the intermediate ring 17(A) and rotating stopper pin 22 can engage with each other.

The modification shown in FIG. 6(*d*) are substantially similar to that shown in FIG. 6(*c*). Although not specifically shown, engagement of pins with each other and engagement of pins and arcuate slots with each other may be combined.

If the range of adjusting movement of the ink blade 8 may be narrow, the intermediate ring 17 may be omitted, and the rotating stopper pin 22 can come into abutment with the fixed stopper pin 23.

The operation of the aforesaid ink fountain apparatus will be described below.

In the aforesaid ink fountain apparatus, ink stored in the groove-like space 6 adheres to the portion of the external periphery of the fountain roller 1 that is exposed in the groove-like space 6. As the fountain roller 1 rotates counterclockwise as viewed in FIG. 1, the ink is sequentially applied to the external periphery of the fountain roller 1 by an amount controlled by the ink supplying port 7 the degree of opening of which is controlled by the front edge of the upper face of the ink blade 8, i.e., the gap between the front edge of the upper face of the ink blade 8 and the external periphery of the fountain roller 1. The thus-applied ink is supplied in the form of a film.

To adjust the amount of ink to be supplied, i.e., the degree of opening of the ink supplying port 7 which is the gap between the lower end of the bottom plate 4 and the external periphery of the fountain roller 1, the motor 18 performs a forward or rearward rotational driving under the control of the driving controlling device (not shown). Thus, the gear shaft 12, i.e., the threaded hole 14, is rotated by means of the driving gear 19, the intermediate gears 20*a* and 20*b* and the gear 13, so that the connecting rod 9 the rotation of which is restricted by the slide key 10 moves forward or rearward in the axial direction by means of the male threaded portion 15 screwed into the threaded hole 14. That is to say, the ink blade 8 slides toward or away from the fountain roller 1 between the inclined face 2*a* of the base 2 and the bottom plate 4. Accordingly, the degree of opening of the ink supplying port 7 which is the gap between the lower end of the bottom plate 4 and the external periphery of the fountain roller 1 is adjusted by the front edge of the upper face of the ink blade 8.

For example, if the motor 18 performs a forward rotational driving, the ink blade 8 moves forward to reduce the degree of opening of the ink supplying port 7. If the motor 18 performs a rearward rotational driving, the ink blade 8 moves rearward to increase the degree of opening of the ink supplying port 7.

For the above-described adjustment of the degree of opening, the rotation of the gear shaft 12, i.e., the forward or rearward movement of the ink blade 8, may also be performed by manually rotating the control knob 16.

The displacement of the ink blade 8 during the adjustment of the degree of opening of the ink supplying port 7 is controlled in the following manner.

The operation of the first embodiment will be described below with reference to FIG. 4 which shows the positional states of the projecting pin 21 (the first projecting portion 21*a* and the second projecting portion 21*b*), the rotating stopper pin 22 and the fixed stopper pin 23, when viewed from the gear 13 to the intermediate ring 17. If the male threaded portion 15 takes a position to be screwed into the threaded hole 14 when the rotating stopper pin 22 abuts on the right side of the first projecting portion 21*a* of the projecting pin 21 whose second projecting pin 21*b* abuts on the right side of the fixed stopper pin 23 as shown in FIG. 4(*a*), the front edge of the upper face of the ink blade 8 connected to the connecting rod 9 takes its lower-limit position at which the degree of opening of the ink supplying port 7 is a minimum. For example, the front edge of the upper face of the ink blade 8 contacts the external periphery of the fountain roller 1 and the degree of opening of the ink supplying port 7 is reduced to zero.

Then, as shown in FIG. 4(*b*), if the gear 13, i.e., the threaded hole 14 of the gear shaft 12, is rotated clockwise, the ink blade 8 moves rearward (to the left) by means of the male threaded portion 15, i.e., the connecting rod 9, so that the front edge of the upper face of the ink blade 8 moves away from the external periphery of the fountain roller 1 and the degree of opening of the ink supplying port 7 progressively increases. Simultaneously, the rotating stopper pin 22 turns clockwise by the clockwise rotation of the gear 13.

Figure 4A:
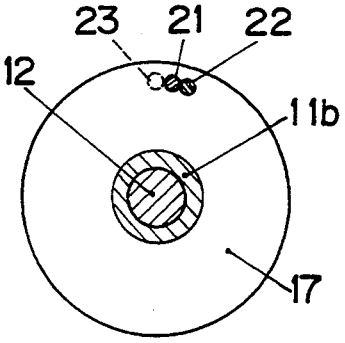
FIG. 4(*a*)–(*e*) is a view explaining the operation of the part for adjusting the degree of opening of the ink supply port of the first embodiment of the ink fountain apparatus according to the invention.
Figure 4B:
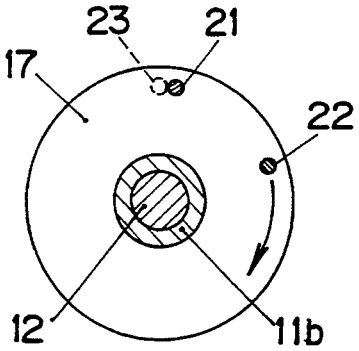
Figure 4C:
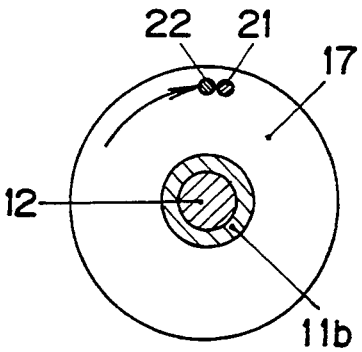
Figure 4D:
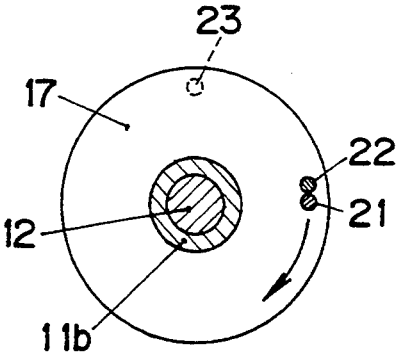
Figure 4E:
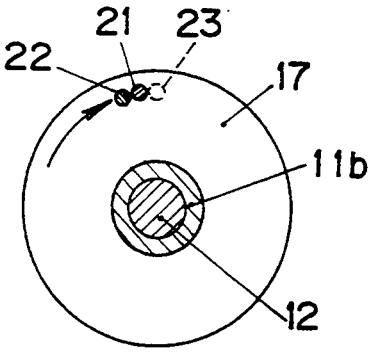

Then, after approximately one rotation, the rotating stopper pin 22 comes into contact with the left side of the first projecting portion 21*a* of the projecting pin 21 (see FIG. 4(C)), and presses the first projecting portion 21*a* to turn together with the first projecting portion 21*a*. Accordingly, the intermediate ring 17 rotates about the periphery of the tubular portion 11*b* of the bracket 11, i.e., the second projecting portion 21*b* of the projecting pin 21 also rotates clockwise (see FIG. 4(*d*)).

After one farther rotation, the second projecting portion 21*b* of the projecting pin 21 comes into contact with the left side of the fixed stopper pin 23 so that the rotation of the second projecting portion 21*b* is stopped. Since the rotation of the first projecting portion 21*a* is stopped, the turn of the rotating stopper pin 22, i.e., the rotation of the gear shaft 12, comes to a stop after approximately two rotations (see FIG. 4(*e*)).

If the male threaded portion 15 is in a position where it is screwed into the threaded hole 14 when the rotation of the gear shaft 12 is stopped in the state shown in FIG. 4(*e*), the front edge of the upper face of the ink blade 8 connected to the connecting rod 9 takes its upper-limit position at which the degree of opening of the ink supplying port 7 is a maximum. For example, the front edge of the upper face of the ink blade 8 is moved away from the lower end of the bottom plate 4 and the degree of opening of the ink supplying port 7 is the maximum.

It will be readily understood that the above-described operation can also be similarly achieved in the case of either of the modifications of the first embodiment shown in FIGS. 6(*a*) and 6(*b*).

Referring to the modifications of the first embodiment shown in FIGS. 6(*c*) and 6(*d*), when the male threaded portion 15 takes a position where it is screwed into the threaded hole 14, namely, when the rotating stopper pin 22 abuts on the first projecting portion 21*a*(A) of the intermediate ring 17(A) in the direction of reverse rotation, the second projecting portion 21*b*(A) abuts on the first projecting portion 21*a*(B) of the second intermediate ring 17(B) in the direction of reverse rotation, and the second projecting portion 21*b*(B) of the intermediate ring 17(B) abuts on the fixed stopper pin 23 in the direction of reverse rotation, the front edge of the upper face of the ink blade 8 connected to the connecting rod 9 takes the lower-limit position at which the degree of opening of the ink supplying port 7 is the minimum. For example, the front edge of the upper face of the ink blade 8 abuts on the external periphery of the fountain roller 1 and the degree of opening of the ink supplying port 7 is reduced to zero.

Then, if the gear 13 is rotated in a predetermined direction (for example, clockwise), the ink blade 8 moves rearward (to the left) via the connecting rod 9 by means of the male threaded portion 15, so that the front edge of the upper face of the ink blade 8 moves away from the external periphery of the fountain roller 1 and the degree of opening of the ink supplying port 7 progressively increases. Simultaneously, the rotating stopper pin 22 turns together with the gear 13.

Then, after approximately one rotation, the rotating stopper pin 22 comes into abutment with the left side of the first projecting portion 21*a*(A) of the intermediate ring 17(A), and presses the first projecting portion 21*a*(A) to continue to turn together with the first projecting portion 21*a*(A). Accordingly, the intermediate ring 17(A) rotates about the periphery of the tubular portion 11*b* of the bracket 11, i.e., the second projecting portion 21*b*(A) also rotates in the same direction. After one more rotation, the second projecting portion 21*b*(A) of the intermediate ring 17(A) comes into abutment with the first projecting portion 21*a*(B) of the second intermediate ring 17(B), and presses the first projecting portion 21*a*(B) to turn together with the first projecting portion 21*a*(B). Accordingly, the second intermediate ring 17(B) also rotates about the periphery of the tubular portion 11*b* of the bracket 11, i.e., the second projecting portion 21*b*(B) also turns in the same direction. After approximately one more rotation, the second projecting portion 21*b*(B) comes into abutment with the fixed stopper pin 23 so that the rotation of the second projecting portion 21*b*(B) is stopped. Therefore, the turn of the rotating stopper pin 22, i.e., the rotation of the gear shaft 12, comes to a stop.

If the male threaded portion 15 is in a position where it is screwed into the threaded hole 14 when the rotation of the gear shaft 12 stopped in the above-described state, the front edge of the upper face of the ink blade 8 connected to the connecting rod 9 takes the upper-limit position at which the degree of opening of the ink supplying port 7 is the maximum. For example, the front edge of the upper face of the ink blade 8 is moved away from the lower end of the bottom plate 4 and the degree of opening of the ink supplying port 7 is the maximum.

Consequently, when the degree of opening of the ink supplying port 7 varies from the maximum limit to the minimum limit or vice versa, the gear shaft 12 makes approximately three rotations.

The case of the second embodiment will be described below with reference to FIG. 5 which shows the rotational states of the first arcuate slot 24, the second arcuate slot 25, the rotating stopper pin 22 and the fixed stopper pin 23 when viewed from the gear to the intermediate ring 17. If the male threaded portion 15 takes a position where it is screwed into the threaded hole 14 when one end of the second arcuate slot 25 of the intermediate ring 17 abuts on the right side of the fixed stopper pin 23 and one end (right-hand end) of the first arcuate slot 24 of the intermediate ring 17 abuts on the rotating stopper pin 22, the front edge of the upper face of the ink blade 8 connected to the connecting rod 9 takes the lower-limit position in which the degree of opening of the ink supplying port 7 is the minimum. For example, the front edge of the upper face of the ink blade 8 abuts on the external periphery of the fountain roller 1 and the degree of opening of the ink supplying port 7 is reduced to zero.

Then, if the gear 13, i.e., the threaded hole 14 of the gear shaft 12, is rotated clockwise, the ink blade 8 moves rearward (to the left) via the male threaded portion 15, i.e., the connecting rod 9, so that the front edge of the upper face of the ink blade 8 moves away from the external periphery of the fountain roller 1 and the degree of opening of the ink supplying port 7 progressively increases. Simultaneously, the rotating stopper pin 22 turns clockwise in the first arcuate slot 24 by the clockwise rotation of the gear 13.

The rotating stopper pin 22 comes into contact with the other end of the first arcuate slot 24 from the left side, and presses the other end of the first arcuate slot 24 to turn together with the intermediate ring 17, which rotates about the periphery of the tubular portion 11*b* of the bracket 11, i.e., the second arcuate slot 25 rotates clockwise.

After that, when the other end of the second arcuate slot 24 comes into contact with the fixed stopper pin 23 from the left side, the turn of the second arcuate slot 24, i.e., the rotation of the intermediate ring 17, is stopped, so that the turn of the rotating stopper pin 22, i.e., the rotation of the gear shaft 12, comes to a stop.

If the male threaded portion 15 is in a position where it is screwed into the threaded hole 14 when the rotation of the gear shaft 12 is stopped in the above-described state, similarly to the case of the first embodiment, the front edge of the upper face of the ink blade 8 connected to the connecting rod 9 takes the upper-limit position in which the degree of opening of the ink supplying port 7 is the maximum. For example, the front edge of the upper face of the ink blade 8 is moved away from the lower end of the bottom plate 4 and the degree of opening of the ink supplying port 7 is the maximum.

In the prior art, the abutment between the stopper projection and the stopper projection provided on one side of the driving transmitting gear is realized by utilizing the amounts of displacement of the side faces of the stopper projections due to one rotation of the gear, i.e., by using at most a thread portion of only one pitch of the engaged screw. As a result, because of the backlash of the thread of the screw, the position in which the ink blade is stopped by the stopper projections may be varied in the range of one rotation of the gear, i.e., the size of one pitch, or the ink blade may stop with the front end faces of the stopper projections butting against each other, so that accuracy will be impaired by the drawbacks. If the ink blade stops with the front end faces of the stopper projections butting against each other, the externally threaded portion of the gear and the screw may bite into each other and the movement between them becomes stiff.

However, in the ink fountain apparatus according to the present invention, the stopper function of defining the maximum and minimum limits of the degree of opening of the ink supply port is effected by the sufficiently long side faces of the planted stopper pins, it is possible to prevent occurrence of the above-described problems.

Further, since there is no need for troublesome adjustment of the attachment position of each stopper projection for the purpose of avoiding the above-described problems, the burden of workers can be reduced.

Further, since it is not necessary to employ any potentiometer for detecting the maximum and minimum limits of the degree of opening of the ink supplying port and any electrical circuit associated therewith, the cost is reduced and no accuracy degradation due to noise occurs. Accordingly, it is possible to provide the maximum and minimum limits of the degree of opening of the ink supply port at a high precision.

While the present invention has been described above with respect to typical preferred embodiments thereof, it should of course be understood that it should not be limited only to them but various changes or modifications may be made without departure from the scope of the invention as defined by the appended claims.

What is claimed is:

1. An ink fountain apparatus comprising:

a storage part for forming an ink storage space in cooperation with an external periphery of a fountain roller, said storage part including a bottom portion having a front edge which is opposed to the external periphery of said fountain roller with a gap defined by said front edge and said external periphery, said gap serving as an ink supplying port;

an ink supply adjusting member movably mounted such as to be movable toward and away from said fountain roller such as to adjust the degree of opening of an ink supplying gap, aligned with said ink supplying port, defined between the front edge of said ink supply adjusting member and said external periphery of said fountain roller;

a screw feeding mechanism having a rotational driving member for moving said ink supply adjusting member toward and away from said fountain roller; and stopper means for restricting the range of rotation of said rotational driving member of said screw feeding mechanism;

said stopper means including a rotation stopper part provided on said rotational driving member and and a fixed stopper part provided on a fixed part attached to said storage part, said rotation stopper part being rotated along with rotation of said rotational driving member in a generally fixed plane so as generally not to move in an axial direction along an axis around which said rotational driving member rotates, and said rotation stopper part over-lapping with said fixed stopper part such that a side portion of said rotation stopper part is engageable with a side portion of said fixed stopper part at a certain degree of rotation of said rotation driving member.

2. An ink fountain apparatus, comprising:

a storage part for forming an ink storage space in cooperation with an external periphery of a fountain roller, said storage part including a bottom portion having a front edge which is opposed to the external periphery of said fountain roller with a gap defined by said front edge and said external periphery, said gap serving as an ink supplying port;

an ink supply adjusting member arranged movably mounted such as to be movable toward and away from said fountain roller such as to adjust the degree of opening of an ink supplying gap, aligned with said ink supplying port, defined between the front edge of said ink supply adjusting member and said external periphery of said fountain roller;

a screw feeding mechanism having a rotational driving member for moving said ink supply adjusting member toward and away from said fountain roller; and stopper means for restricting the range of rotation of said rotation driving member of said screw feeding mechanism;

said stopper means including a fixed stopper part provided on a fixed part attached to said storage part, a rotation stopper part provided on said rotational driving member of said screw feeding mechanism, and at least one intermediate rotation stopper part provided on an intermediate free-rotating member which is rotatably disposed in coaxial relationship with respect to said rotational driving member, said rotation stopper part being rotated along with rotation of said rotational driving member in a generally fixed plane so as generally not to move in an axial direction along an axis around which said rotational driving member rotates, and said at least one intermediate rotation stopper part being rotated along with rotation of said intermediate free-rotating member in a generally fixed plane so as generally not to move in an axial direction along an axis around which said intermediate free-rotation member rotates, and said rotation stopper part over-lapping with at least one said intermediate rotation stopper part such that a side portion of said rotation stopper part is engageable with a side portion of said at least one said intermediate stopper part, and at least one of said at least one intermediate rotation stopper part of said intermediate free-rotating member over-lapping with said fixed stopper part that a side portion of said at least one said intermediate stopper part is engageable with a side portion of said fixed stopper part of said fixed part.

3. An ink fountain apparatus, comprising:

a storage part for forming an ink storage space in cooperation with an external periphery of a fountain roller, said storage part including a bottom portion having a front edge which is opposed to the external periphery of said fountain roller with a gap defined by said front edge and said external periphery, said gap serving as an ink supplying port;

an ink supply adjusting member movably mounted such as to be movable toward and away from said fountain roller such as to adjust a degree of opening of an ink supplying gap, aligned with said ink supplying port, defined between the front edge of said ink supply adjusting member and said external periphery of said fountain roller;

a screw feeding mechanism having a rotational driving member for moving said ink supply adjusting member toward and away from said fountain roller; and stopper means for restricting the range of rotation of said rotation driving member of said screw feeding mechanism;

said stopper means including a fixed stopper part provided on a fixed part attached to said storage part, a rotation stopper part provided on said rotation driving member of said screw feeding mechanism, and at least one intermediate rotation stopper part provided on each of a plurality of intermediate free-rotating members which are rotatably disposed in coaxial relationship to with respect to said rotational driving member, and said rotation stopper part over-lapping with one said intermediate stopper part of one of said intermediate free-rotating members such that a side portion of said at least one rotation-stopper part is engageable with a side portion of said one of said intermediate stopper part, one said intermediate stopper part of said one of said intermediate free-rotating members over-lapping with one said intermediate stopper part of another of said intermediate free-rotating members such as to be engageable therewith, and said fixed stopper part of said fixed part being engageable with one of said intermediate stopper part of another of said intermediate free-rotating members.

* * * * *